US010724488B2

(12) United States Patent
Grandi et al.

(10) Patent No.: US 10,724,488 B2
(45) Date of Patent: Jul. 28, 2020

(54) ANTI-REJECTION DEVICE FOR AN INJECTION VALVE

(71) Applicant: CPT Group GmbH, Hannover (DE)

(72) Inventors: Mauro Grandi, Leghorn (IT); Stefano Filippi, Castel' Anselmo Collesalvetti (IT); Willibald Schürz, Pielenhofen (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/339,170

(22) PCT Filed: Oct. 10, 2017

(86) PCT No.: PCT/EP2017/075854
§ 371 (c)(1),
(2) Date: Apr. 3, 2019

(87) PCT Pub. No.: WO2018/069347
PCT Pub. Date: Apr. 19, 2018

(65) Prior Publication Data

US 2019/0226439 A1 Jul. 25, 2019

(30) Foreign Application Priority Data

Oct. 12, 2016 (EP) ..... 16193407

(51) Int. Cl.
*F02M 63/00* (2006.01)
*F02M 55/04* (2006.01)

(52) U.S. Cl.
CPC ..... *F02M 63/0036* (2013.01); *F02M 55/04* (2013.01); *F02M 2200/315* (2013.01)

(58) Field of Classification Search
CPC ..... F02M 63/0036; F02M 55/04; F02M 2200/315
See application file for complete search history.

(56) References Cited

U.S. PATENT DOCUMENTS

2003/0094513 A1 5/2003 Luft ..... 239/533.9
2010/0012091 A1* 1/2010 Kannan ..... F02M 55/004 123/447

FOREIGN PATENT DOCUMENTS

EP 2 333 297 B1 3/2013 ..... F02M 51/06
GB 2 069 623 A 8/1981 ..... F02M 59/46
(Continued)

OTHER PUBLICATIONS

Extended European Search Report, Application No. 16193407.0, 6 pages, dated Feb. 17, 2017.
(Continued)

*Primary Examiner* — Xiao En Mo
(74) *Attorney, Agent, or Firm* — Slayden Grubert Beard PLLC

(57) ABSTRACT

Various embodiments include an anti-reflection device for preventing the reflection of pressure waves inside an injection valve comprising: a cylindrical base body with a longitudinal axis L to be orientated parallel to a propagation direction of a pressure wave; a first section adjacent to a first base side having a cavity shaped as a hollow cone, a longitudinal axis of the cone orientated parallel to the longitudinal axis L of the device, and a base area of the cone coplanar with the first base side of the cylindrical base body; and a second section adjacent to the second base side comprising a through-hole in fluid communication with the cone, hydraulically linking the second base side with the first base side. The through-hole makes an angle $\alpha$ with the longitudinal axis L, wherein $40° \leq \alpha \leq 60°$.

10 Claims, 2 Drawing Sheets

(56) References Cited

FOREIGN PATENT DOCUMENTS

| | | | | |
|---|---|---|---|---|
| WO | 02/10583 | A1 | 2/2002 | ..... F02M 51/06 |
| WO | 2018/069347 | A1 | 4/2018 | ..... F02M 55/04 |

OTHER PUBLICATIONS

International Search Report and Written Opinion, Application No. PCT/EP2017/075854, 10 pages, dated Jan. 9, 2018.

* cited by examiner

ANTI-REJECTION DEVICE FOR AN INJECTION VALVE

CROSS-REFERENCE TO RELATED APPLICATIONS

This application is a U.S. National Stage Application of International Application No. PCT/EP2017/075854 filed Oct. 10, 2017, which designates the United States of America, and claims priority to EP Application No. 16193407.0 filed Oct. 12, 2016, the contents of which are hereby incorporated by reference in their entirety.

TECHNICAL FIELD

The present disclosure relates to injection valves. Various embodiments may include anti-reflection devices for preventing the reflection of pressure waves inside an injection valve and/or injection valves with such an anti-reflection device.

BACKGROUND

An injection valve for injecting fuel directly or indirectly into a combustion chamber of vehicle is disclosed in document EP 2 333 297 B1. One typical problem of such injection valves, in particular of high-pressure valves, is the generation of pressure waves or pressure pulsations caused by an injection event. Internal pressure pulsation causes problems in particular for multiple injection applications, because when pressure conditions inside the injector are not stable or not known at the time of opening of the valve, the amount of injected fuel cannot be controlled properly.

SUMMARY

The teachings of the present disclosure describe a device which helps solve the above-mentioned problems. Furthermore, they describe injection valves, in which the risk that pressure pulsations interfere with the injection events is particularly small. For example, some embodiments include an anti-reflection device (1) for preventing the reflection of pressure waves inside an injection valve (23), the anti-reflection device (1) comprising: an essentially cylindrical base body (3) with a first base side (5), a second base side (7) and an outer surface (9); a longitudinal axis L intended to be orientated parallel to a propagation direction of a pressure wave, the longitudinal axis penetrating the first base side (5) and the second base side (7); a first section (11) of the device (1) adjacent to the first base side (5) having a cavity being shaped as a hollow cone (15), a longitudinal axis 1 of the cone (15) being orientated parallel to the longitudinal axis L of the device (1) and a base area (17) of the cone (15) being coplanar with the first base side (5) of the cylindrical base body (3); and a second section (13) of the device (1) adjacent to the second base side (7) comprising at least one through-hole (21), the at least one through-hole (21) being in fluid communication with the cone (15), the at least one through-hole (21) and the hollow cone (15) hydraulically linking the second base side (7) with the first base side (5), wherein the at least one through-hole (21) makes an angle $\alpha$ with the longitudinal axis L with $40° \leq \alpha \leq 60°$.

In some embodiments, the hollow cone (15) has an angle of opening $\gamma$ with $30° \leq \gamma \leq 100°$.

In some embodiments, at least one, but not more than six through-holes (21) are provided in the second section.

In some embodiments, the at least one through-hole (21) has a diameter d with $0.2\ \text{mm} \leq d \leq 1\ \text{mm}$.

As another example, some embodiments include an injection valve (23), comprising: a valve body (25) with a central longitudinal axis (L') comprising a cavity (27) with a fluid inlet portion (29) and a fluid outlet portion (31), a valve needle (33) axially moveable in the cavity (27), the valve needle (33) preventing a fluid flow through the fluid outlet portion (31) in a closing position and releasing the fluid flow through the fluid outlet portion (31) in further positions, an electro-magnetic actuator unit (35) being designed to actuate the valve needle (33), and at least one anti-reflection device (1) according to any one of the previous claims being arranged inside the cavity (27).

In some embodiments, an anti-reflection device (1) is arranged upstream of a fuel filter element (39) of the injection valve (23).

In some embodiments, an anti-reflection device (1) is integrated into a fuel filter element (39) of the injection valve (23).

In some embodiments, an anti-reflection device (1) is arranged downstream of a fuel filter element (39) of the injection valve (23).

In some embodiments, an anti-reflection device (1) is arranged downstream of an armature (37) of the electro-magnetic actuator unit.

In some embodiments, the anti-reflection device (1) is mounted inside the cavity (27) with the first base side (5) oriented towards the fluid outlet portion (31) and the second base side (7) oriented towards the fluid inlet portion (29).

BRIEF DESCRIPTION OF THE DRAWINGS

Further advantages, embodiments, and developments of the antireflection devices and the injection valves described herein are apparent from the exemplary embodiments which are described below in association with the schematic figures.

DETAILED DESCRIPTION

Figure 1:
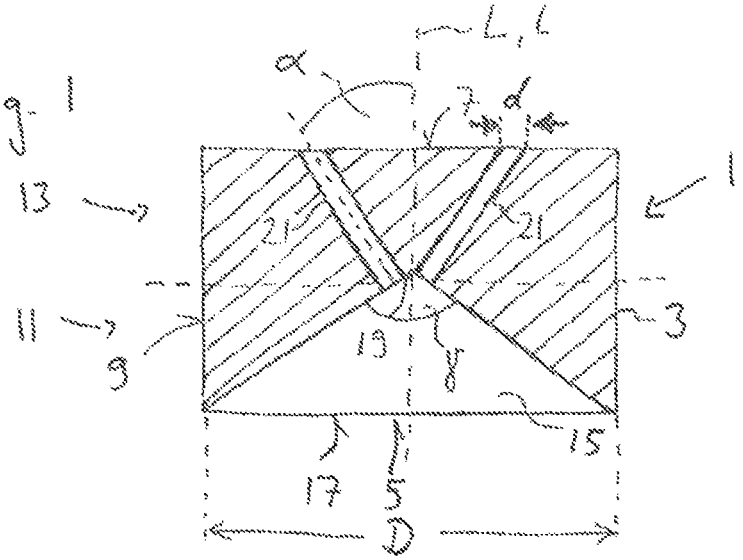
FIG. 1 shows an anti-reflection device incorporating teachings of the present disclosure.

In some embodiments, an anti-reflection device for preventing the reflection of pressure waves inside an injection valve comprises a base body with a first base side, a second base side, and an outer surface. In some embodiments, the base body is essentially cylindrical, i.e. it has a cylindrical basic shape. The anti-reflection device has a longitudinal axis L intended to be orientated parallel to a propagation direction of a pressure wave. The outer surface extends in particular circumferentially around the longitudinal axis. The longitudinal axis penetrates the first base side and the second base side. When the base body is essentially cylindrical, the longitudinal axis L is essentially parallel to the outer surface of the base body.

A first section of the device—in particular a first section of the base body—adjacent to the first base side has a cavity shaped as a hollow cone, a longitudinal axis 1 of the cone being orientated parallel to the longitudinal axis L of the device. In some embodiments, the base area of the cone is coplanar with the first side of the cylindrical base body. To put it differently, a first section of the base body has in particular a cone-shaped cavity expanding in direction towards the first base side and opening out into the first base side.

A second section of the device—in particular a second section of the base body—adjacent to the second base side comprises at least one through-hole, the at least one through-hole being in fluid communication with the cavity, the at least one through-hole and the hollow cone hydraulically linking the second base side with the first base side. To put it differently, a second section of the base body is penetrated by at least one through-hole extending from the second base side into the base body and opening out into the cone-shaped cavity.

In some embodiments, a fluid path is made through the anti-reflection device which hydraulically links the first side and the second side of the device. The fluid path is through the cavity shaped as a hollow cone and through the through-hole in the second section. In some embodiments, the hollow cone prevents—or at least largely dampens—the reflection of pressure waves which propagate towards the anti-reflection device from the first base side. This is due to the low hydraulic impedance of the hollow cone. It ensures that pressure waves are transmitted, but not reflected at the device. The through-holes help to dissipate energy of the pressure waves. In some embodiments, pressure waves propagating towards the device from the first base side are transmitted, while pressure waves propagating towards the device from the second base side are reflected due to the high impedance of the at least one through-hole.

In some embodiments, the at least one through-hole is not arranged parallel to the longitudinal axis L of the device, but makes an angle $\alpha$ with the longitudinal axis L, where $40° \leq \alpha \leq 60°$ applies. It has been found, that such sloping through-holes dissipate energy of a pressure wave effectively.

In some embodiments, the hollow cone has an angle of opening $\gamma$ where $30° \leq \gamma \leq 100°$ applies. In some embodiments, this range of angles ensures a low impedance of the anti-reflection device. The optimal angle $\gamma$ also depends on the diameter and the length of the anti-reflection device. With a given diameter and the limited space available for the anti-reflection device, the angle $\gamma$ will typically rather be around or above 90° than around 30°.

In some embodiments, at least one, but not more than six through-holes are provided in the second section. It has been found, that the effect of the through-holes can be achieved with a limited number of through-holes. As the formation of sloping through-holes is somewhat elaborate, it will save time and costs to limit the number of through-holes to six.

In some embodiments, the at least one through-hole has a diameter d where $0.2\ \text{mm} \leq d \leq 1\ \text{mm}$ applies. A through-hole with such a diameter d provides a large impedance for pressure waves in an injector and therefore prevents the transmission of pressure waves from the second base side. Thus, noise from the outside can be decoupled. Furthermore, a through-hole with such a diameter creates a pressure drop and therefore dissipates energy of a passing pressure wave.

In some embodiments, an injection valve comprises a valve body with a central longitudinal axis and with a cavity with a fluid inlet portion and a fluid outlet portion. The injection valve further comprises a valve needle axially movable in the cavity, the valve needle preventing a fluid flow through the fluid outlet portion in a closing position and releasing the fluid flow through the fluid outlet portion in further positions. The injection valve further comprises an electromagnetic actuator unit which is designed to actuate the valve needle. The injection valve comprises at least one anti-reflection device as described above, which is arranged inside the cavity.

In some embodiments, by placing the anti-reflection device inside the cavity, reflection of pressure waves can be prevented. It has been found, that pressure pulsation inside an injection valve cannot be entirely prevented, but the anti-reflection device makes it possible to prevent the pressure pulsations from interacting in an undesirable way with the injections.

In some embodiments, an anti-reflection device is arranged upstream of a fuel filter element of the injection valve. In some embodiments, an anti-reflection device could be integrated into a fuel filter element of the injection valve. In some embodiments, an anti-reflection device could be arranged downstream of the fuel filter element of the injection valve, in particular downstream of an armature of the electromagnetic actuator unit. The position of the anti-reflection device may be chosen depending on the injector design. In injector types, where the armature is movable with respect to the needle, it might be advantageous to arrange the anti-reflection device downstream of the armature.

In some embodiments, the anti-reflection device is mounted inside the cavity with the first base side oriented towards the fluid outlet portion and the second base side oriented towards the fluid inlet portion. This orientation may minimize pressure waves at the fluid outlet portion of the fluid injector.

The anti-reflection device 1 according to FIG. 1 has a cylindrical base body 3 with a first base side 5, a second base side 7 and a circumferential outer surface 9. The longitudinal axis of the device 1 is denoted with L. The device 1 comprises two sections, the first section 11 and the second section 13. The first section 11 extends from the first base side 5 to a central region of the base body 3. The second section 13 extends from the second base side 7 to the central region of the base body 3. The first and second sections 11, 13 may overlap in the central region of the base body 3.

Each section provides a hydraulic passage for fluid flow through the device 1:

The first section 11 comprises a cavity which is shaped as a hollow cone 15. The cone 15 has a base side 17 which is coplanar with the first base side 5 and also part of the first base side 15. A longitudinal axis 1 of the cone 15 is in this embodiment identical with the longitudinal axis L of the device 1. The apex 19 of the cone 15 is orientated towards the second base side 7 of the device 1 and positioned in the central region of the base body 3.

The second section 13 comprises a plurality of through-holes 21, which hydraulically link the second base side 7 of the device 1 with the cavity shaped like a hollow cone 15. In some embodiments, the through-holes 21 extend from the second base side 7 into the base body 3 to a surface of the cone-shaped cavity in the first section 11. In some embodiments, the through-holes 21 open into the surface of the cavity in a region adjacent to the apex 19 of the cone.

In some embodiments, the through holes 21 have a diameter d and make an angle $\alpha$ with the longitudinal axis L. The through-holes 21, which may be bores, have a diameter d which is much smaller than a diameter D of the base area 17 of the cone 15. While the diameter D may be in the range of centimeters, the diameter d of the through-holes is $0.2\ \text{mm} \leq d \leq 1\ \text{mm}$. As a consequence, the hydraulic impedance of the device 1 is very different for a pressure wave approaching from the first base side 5 compared to a pressure wave approaching from the second base side 7.

For a wave approaching from the first base side 5, there is no rapid change in diameter, as the diameter D is in the range of the diameter of the injector itself. Therefore, no reflection of pressure waves occurs. On the other hand, a wave approaching from the second base side 7 experiences a large change in hydraulic cross-section, because the diameter d of the through-holes is much smaller than the diameter of the injector. Accordingly, a wave approaching from the second base side 7, like noise from the outside of the injector, is largely reflected and prevented from entering further into the injector.

Figure 2:
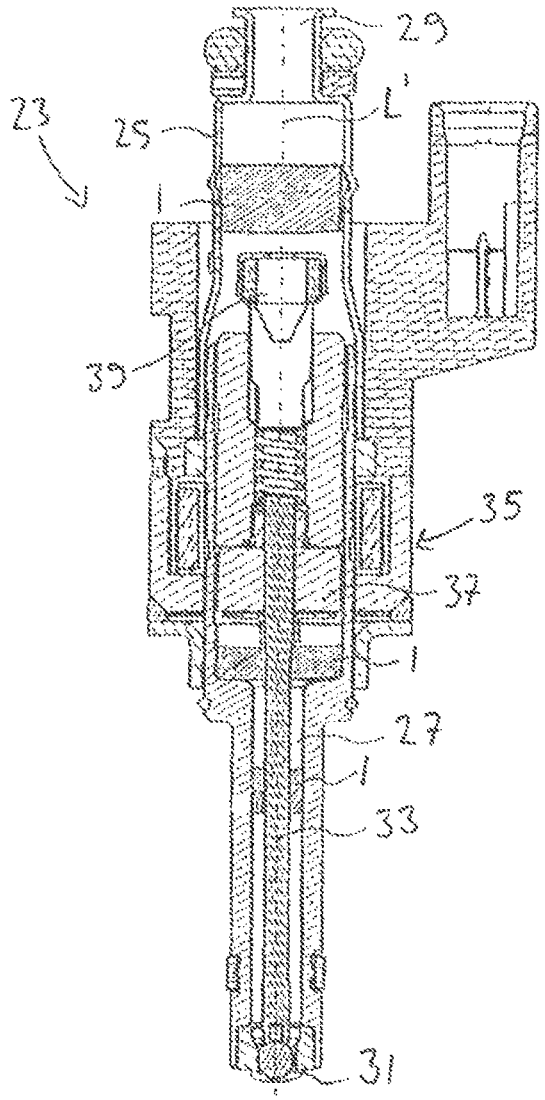
FIG. 2 shows an injection valve with an anti-reflection device incorporating teachings of the present disclosure.

FIG. 2 shows an injection valve 23 for injecting fuel into a combustion chamber of a vehicle. The injection valve 23 could be a gasoline or Diesel injector and could be designed for either indirect low pressure or direct high-pressure applications. The injection valve 23 comprises a valve body 25 with a central longitudinal axis L'. The valve body 25 encloses a cavity 27 with a fluid inlet portion 29 and a fluid outlet portion 31. A valve needle 33 is axially moveable in the cavity 27 and prevents a fluid flow through the fluid outlet portion 31 in a closing position and releases fluid flow through the fluid outlet portion 31 in further positions. To actuate the valve needle 33, an electro-magnetic actuator unit 35 is provided comprising an armature 37. Fuel entering the cavity 27 through the fluid inlet portion 29 is filtered by a filter element 39.

When the injection valve 23 opens and fluid is released through the fluid outlet portion 31, a pressure wave is created in the cavity 27. The pressure wave propagates in the cavity 27 and may be internally reflected. A reflected pressure wave may interfere with following injections and makes the behavior of the injection valve 23 unstable.

To prevent the reflection of pressure waves, an anti-reflection device 1 is provided inside the cavity 27. FIG. 2 shows three such anti-reflection devices 1, a first one upstream of the filter element 39, a second one downstream of the armature 37, bearing on a step of the valve body 25, and a third one further downstream of the armature 37, in a small-diameter section of the cavity 27 downstream of the above-mentioned step which delimits, in downstream direction, a large-diameter section of the cavity 27 in which the armature 37 is arranged. Typically, only one anti-reflection device 1 would be provided, although it is possible and could be advantageous to provide more than one anti-reflection device 1. In most applications, the effect of one anti-reflection device 1 would be sufficient.

The anti-reflection device 1 is mounted inside the cavity 27 with the first base side 5 oriented towards the fluid outlet portion 31 and the second base side 7 oriented towards the fluid inlet portion 29. Thus, pressure waves approaching from the direction of the fluid inlet portion 29 are reflected, while pressure waves approaching from the direction of the fluid outlet portion 31 are transmitted. Therefore, pressure pulsation due to injection can be led out of the injection valve 23 and dissipated, while noise from outside cannot penetrate further into the injection valve 23. The anti-reflection device 1 may be made of metal-alloys or plastic materials validated for automotive applications and produced e.g. by a forming/stamping process.

Figure 3:
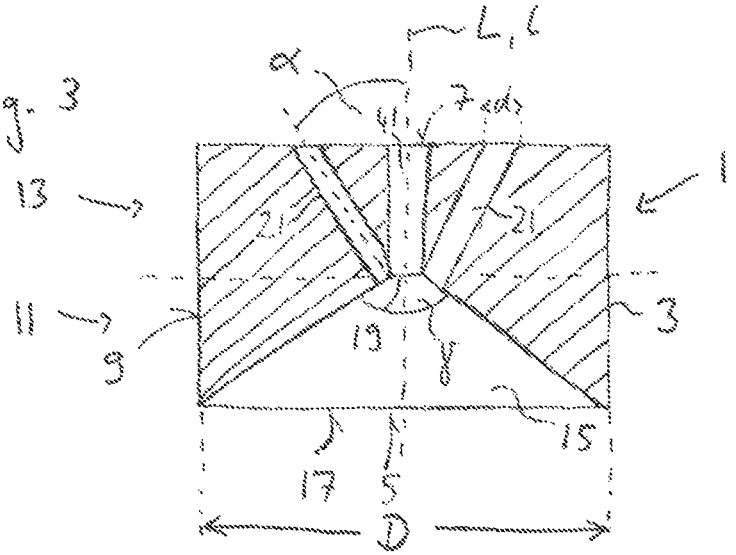
FIG. 3 shows an anti-reflection device incorporating teachings of the present disclosure.

FIG. 3 shows an anti-reflection device incorporating teachings of the present disclosure which is placeable below the armature in the positions of the second and the third device 1 shown in FIG. 2. This device 1 differs from the one shown in FIG. 1 in that it comprises a central opening 41 to receive the valve needle 33. While the anti-reflection device according to the first embodiment is best suited for installation upstream of the filter element 39 or for being combined with the filter element 39, the anti-reflection device according to the second embodiment may be preferably installed in the above mentioned position bearing on the step of the cavity 27 or in the small-diameter section of the cavity 27, where it is penetrated by the valve needle 33.

What is claimed is:

1. An anti-reflection device for preventing the reflection of pressure waves inside an injection valve, the anti-reflection device comprising:

an essentially cylindrical base body with a first base side, a second base side, and an outer surface;

a longitudinal axis L intended to be orientated parallel to a propagation direction of a pressure wave, the longitudinal axis penetrating the first base side and the second base side;

a first section adjacent to the first base side having a cavity shaped as a hollow cone, a longitudinal axis of the cone orientated parallel to the longitudinal axis L of the device, and a base area of the cone coplanar with the first base side of the cylindrical base body; and a second section adjacent to the second base side comprising a through-hole, in fluid communication with the cone, hydraulically linking the second base side with the first base side;

wherein the through hole makes an angle $\alpha$ with the longitudinal axis L, wherein $-40° \leq \alpha \leq 60°$.

2. The anti-reflection device according to claim 1, wherein the hollow cone has an angle of opening $\gamma$, wherein $30° \leq \gamma \leq 100°$.

3. The anti-reflection device according to claim 1, further comprising up to six through-holes in the second section.

4. The anti-reflection device according to claim 1, wherein the through hole has a diameter d, wherein 0.2 mm$\leq$d$\leq$1 mm.

5. An injection valve, comprising:

a valve body with a central longitudinal axis comprising a cavity with a fluid inlet portion and a fluid outlet portion;

a valve needle axially moveable in the cavity, the valve needle preventing a fluid flow through the fluid outlet portion in a closed position and releasing the fluid flow through the fluid outlet portion in further positions;

an electro-magnetic actuator unit to actuate the valve needle; and one anti-reflection device arranged inside the cavity, the anti-reflection device comprising:

an essentially cylindrical base body with a first base side, a second base side, and an outer surface;

a longitudinal axis L intended to be orientated parallel to a propagation direction of a pressure wave, the longitudinal axis penetrating the first base side and the second base side;

a first section adjacent to the first base side having a cavity shaped as a hollow cone, a longitudinal axis of the cone orientated parallel to the longitudinal axis L of the device, and a base area of the cone coplanar with the first base side of the cylindrical base body; and a second section adjacent to the second base side comprising a through-hole in fluid communication with the cone, hydraulically linking the second base side with the first base side;

wherein the through-hole makes an angle $\alpha$ with the longitudinal axis L, wherein $40° \leq \alpha \leq 60°$.

6. The injection valve according to claim 5, wherein the anti-reflection device is arranged upstream of a fuel filter element of the injection valve.

7. The injection valve according to claim 5, wherein the anti-reflection device is integrated into a fuel filter element of the injection valve.

8. The injection valve according to claim 5, wherein the anti-reflection device is arranged downstream of a fuel filter element of the injection valve.

9. The injection valve according to claim 5, wherein the anti-reflection device is arranged downstream of an armature of the electro-magnetic actuator unit.

10. The injection valve according to claim 5, wherein the anti-reflection device is mounted inside the cavity with the first base side oriented towards the fluid outlet portion and the second base side oriented towards the fluid inlet portion.

* * * * *